US010830002B2

(12) United States Patent
Hale

(10) Patent No.: US 10,830,002 B2
(45) Date of Patent: Nov. 10, 2020

(54) BUCKLING-RESISTANT SUCKER ROD

(71) Applicant: Megalex LLC, Houston, TX (US)

(72) Inventor: Mitchell Hale, Houson, TX (US)

(73) Assignee: MEGALEX, LLC, Houston, TX (US)

( * ) Notice: Subject to any disclaimer, the term of this patent is extended or adjusted under 35 U.S.C. 154(b) by 82 days.

(21) Appl. No.: 15/957,472

(22) Filed: Apr. 19, 2018

(65) Prior Publication Data

US 2018/0305983 A1 Oct. 25, 2018

Related U.S. Application Data

(60) Provisional application No. 62/523,357, filed on Jun. 22, 2017, provisional application No. 62/487,544, filed on Apr. 20, 2017.

(51) Int. Cl.
*E21B 17/00* (2006.01)
*E21B 43/12* (2006.01)

(52) U.S. Cl.
CPC ..... *E21B 17/00* (2013.01); *E21B 43/127* (2013.01)

(58) Field of Classification Search
CPC ..... E21B 17/00; E21B 17/1071; E21B 43/127
See application file for complete search history.

(56) References Cited

U.S. PATENT DOCUMENTS 2,453,079 A * 11/1948 Rossmann ..... E21B 17/00 74/579 R
3,370,894 A * 2/1968 Pourchot ..... E21B 17/1071 166/241.4
4,468,309 A * 8/1984 White ..... C23C 14/32 427/528
4,516,608 A * 5/1985 Titus ..... F16L 9/14 138/120
10,378,209 B2 * 8/2019 Martin ..... B29C 70/025

* cited by examiner

*Primary Examiner* — D. Andrews
(74) *Attorney, Agent, or Firm* — Steins & Associates, P.C.

(57) ABSTRACT

A Buckling-resistant Sucker Rod for well pumps. The present invention comprises a sucker rod assembly in which the rod itself is held in tension between opposing fittings, and in which a sleeve surrounds the rod, occupying the space between the fittings. In one version, the buckling-resistant rod is assembled such that the end fittings are placed under tension prior to the installation of the sleeve, In another version, the sleeve is designed to be extendable until it places the rod segment under tension by pressing outwardly on the end fittings. Thus, the sleeve, or the combination of the sleeve and its extension, can absorb all compressive forces transmitted through the fittings, while the rod remains in a condition of tension. The invention enhances the efficiency of oil well operation, by using light-weight sucker rods, while minimizing down time due to breakage of the rods.

17 Claims, 24 Drawing Sheets

MEGA

Assembly Step 1
Slide Compression Sleeve Assembly
over Megalex Rod Body

Assembly Step 2
Secure Top End Fitting into Place

Assembly Step 3
Position Sleeve Against Top End Fitting

BUCKLING-RESISTANT SUCKER ROD

This application is filed within one year of, and claims priority to Provisional Application Ser. Nos. 62/487,544, filed Apr. 20, 2017 and 62/523,357, filed Jun. 22, 2017.

BACKGROUND OF THE INVENTION

1. Field of the Invention

This invention relates generally to well pump systems and, more specifically, to a Buckling-resistant Sucker Rod.

2. Description of Related Art

In a typical oil well, a pumping unit sits on the surface, and drives a pump located deep in the well. The connection between the pumping unit and the pump is made by a string of sucker rods. The sucker rods are typically made of steel, fiberglass, or carbon fiber. The rods are provided with male or female threaded fittings on each end, and joined together by couplings, so that the rods can be screwed together to form a string long enough to extend substantially to the bottom of the well.

The pumping unit at the surface provides upward and downward motion, lifting the string of sucker rods up and down. This up and down action, being transmitted to the pump deep in the well, causes the pump to pump oil to the surface.

Steel rods are relatively heavy, so it has been known to use light-weight, high-strength carbon fiber rods, as sucker rods. When one replaces steel with carbon fiber as the material for the rods, the pumping unit can lift a lighter load while producing the same quantity of oil.

On the down stroke of the pumping unit, the rods deepest in the rod string become compressed. Such compression can cause the rods to buckle, which can be destructive to the rods, especially carbon fiber rods and fiberglass rods.

Indeed, a major disadvantage of fiberglass and carbon fiber rods is that they are prone to failure if they are compressed. Thus, to preserve their useful life, fiberglass and carbon fiber rods should be kept in tension.

In the prior art, it has therefore been considered necessary to use steel rods in the deeper depths of the well, while restricting the use of fiberglass and carbon fiber rods to the shallower depths, where they are less likely to be compressed. This procedure reduces the likelihood of destruction of the rods, but it limits the usefulness of the fiberglass and carbon fiber, as the fiberglass or carbon fiber is restricted to only a part of the overall string.

The problem of buckling of sucker rods has been exacerbated by requirements imposed by new drilling techniques. For example, multi-well pad drilling sites have become popular since 2006. As of the present writing, 60% of all wells drilled are drilled from centralized multi-well pad drill sites. Wells drilled from multi-well pad drill sites deviate from the vertical in order to reach the intended bottom hole location. But such deviated wells cause frictional drag on sucker rods. Frictional drag on the down stroke can cause the rods at shallower depths to go into compression, causing destructive buckling.

Sucker rod failures have therefore increased substantially since the advent of multi-well pad drilling. These rod failures can be attributed to rods going into compression due to the forces inherent in drilling deviated wells.

The present invention provides a sucker rod structure which avoids the problems described above. The sucker rod of the present invention is resistant to buckling under compression, and can therefore be used at all points in the rod string, even at the lower depths of the well. The rod of the present invention is less likely to fail than comparable rods of the prior art.

SUMMARY OF THE INVENTION

The present invention comprises a sucker rod assembly in which the rod itself is held in tension between opposing fittings, and in which a sleeve surrounds the rod, occupying the space between the fittings. In one embodiment, the rod may be made of carbon fiber, and the sleeve may be made of steel. The invention is not limited by the choice of materials, however. In one embodiment, the sleeve does not extend along the entire length of the rod, but instead is positioned adjacent to a clamshell spacer, inserted over the rod, the spacer comprising an extension of the sleeve. The sleeve thus effectively extends between the opposing fittings. Thus, the sleeve, or the combination of the sleeve and its extension, can absorb all compressive forces transmitted through the fittings, while the rod remains in a condition of tension. The invention also includes a method of assembling the sucker rod described above. According to this method, the rod is inserted into an end fitting, and an assembled sleeve is slid over the rod. A second end fitting is installed on the opposite end of the rod. The rod is then held by a fixture, and the sleeve is moved towards the fixture, and the newly installed end fitting, exposing a space between the sleeve and the opposing end fitting. While the rod body is placed in tension, the space between the sleeve and the opposing fitting is filled by the insertion of a clamshell spacer, which acts as an extension of the sleeve. The tension is released, and the resulting assembly is ready to be connected to other sucker rods to form a longer string. The present invention therefore has the primary object of providing a sucker rod assembly which is resistant to buckling. The invention has the further object of making it feasible to use fiberglass and carbon fiber sucker rods throughout a well, including locations near the bottom of the well. The invention has the further object of enhancing the efficiency of oil well operation, by using light-weight sucker rods, while minimizing down time due to breakage of the rods.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Buckling-resistant Sucker Rod.

Figure 1A:
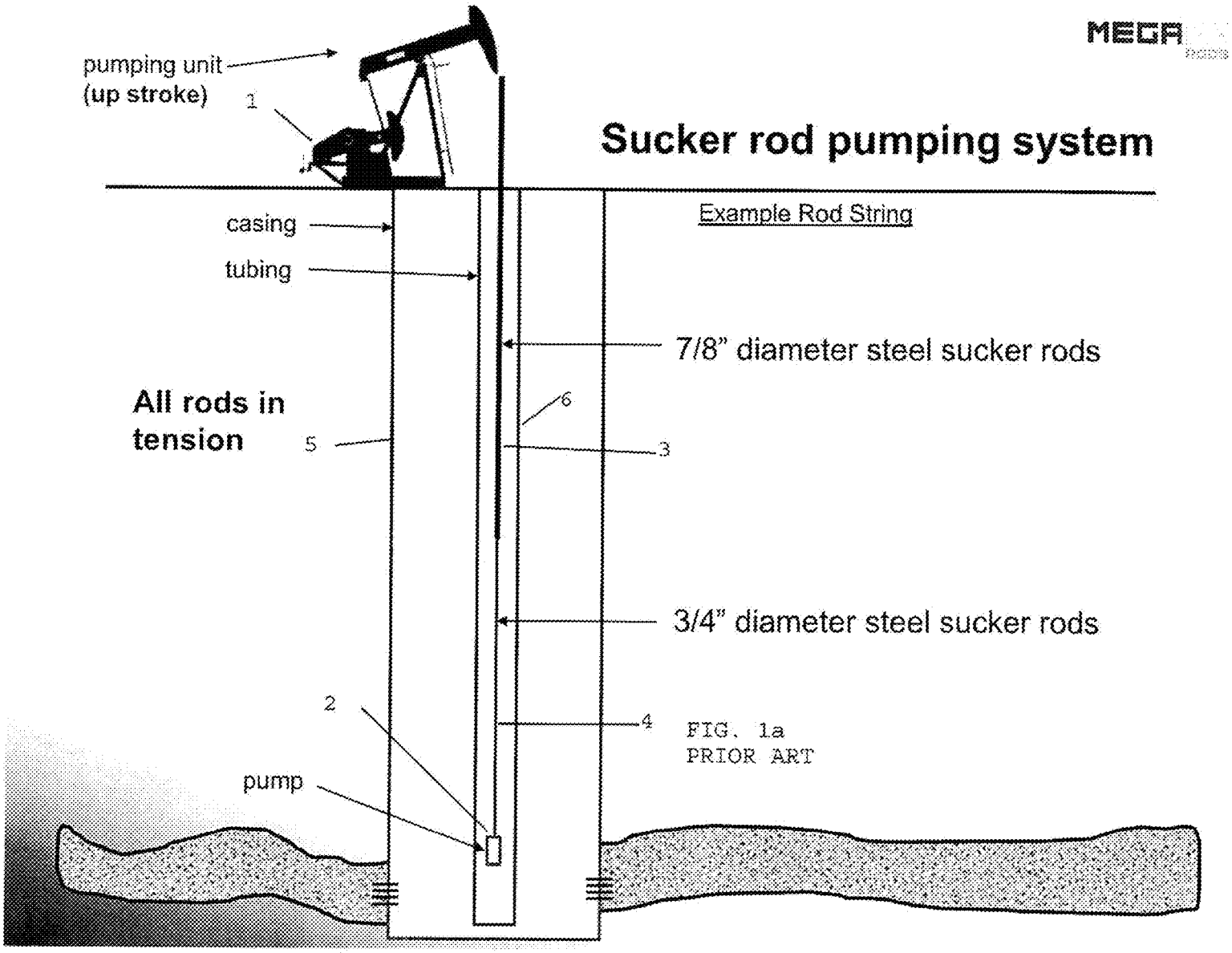
FIG. 1a PRIOR ART
FIG. 1*a* provides a schematic diagram showing a sucker rod pumping system of the prior art, the figure showing the pumping unit on the up stroke, wherein all of the sucker rods are in tension.
Figure 1B:
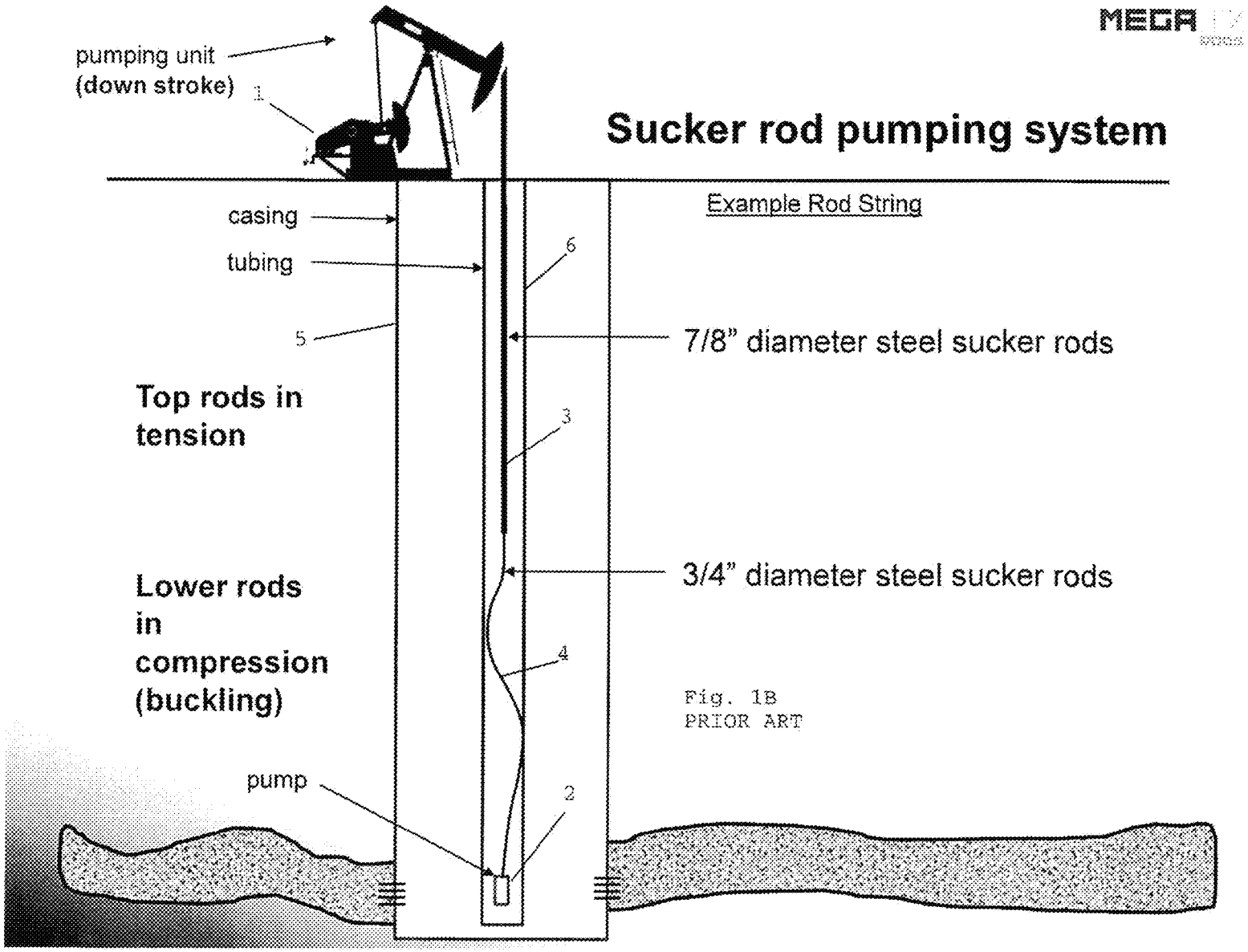
Fig. 1B PRIOR ART
FIG. 1*b* provides a diagram similar to FIG. 1*a*, but showing the pumping unit on the down stroke, wherein the lower sucker rods are in compression.

The present invention can best be understood by initial consideration of FIGS. 1*a* and 1*b*.[1] FIGS. 1*a* and 1*b* illustrate a pumping system of the prior art A pumping unit 1 sits at the surface of a well, the well having a casing 5 and a tubing 6. The pumping unit lifts a string of sucker rods up and down, within the tubing 6, to operate a pump 2 near the bottom of the well. In the example of FIG. 1*a*, the sucker rods are made of steel, the diameter of the upper sucker rods 3 being larger than those of the lower sucker rods 4. At the moment represented by FIG. 1*a*, the pumping unit is operating on its "up stroke", and all of the sucker rods are in tension.

[1] As used throughout this disclosure, element numbers enclosed in square brackets [ ] indicates that the referenced element is not shown in the instant drawing figure, but rather is displayed elsewhere in another drawing figure.

In FIG. 1*b*, the pumping unit 1 is operating on its "down stroke". The upper sucker rods 3 are still in tension, but the lower rods 4 are in compression, and tend to buckle. The buckling may be exaggerated somewhat in the figure, for purposes of illustration. The problem of buckling is especially destructive when the rods are made of carbon fiber or fiberglass.

Figures 2A, 2B:
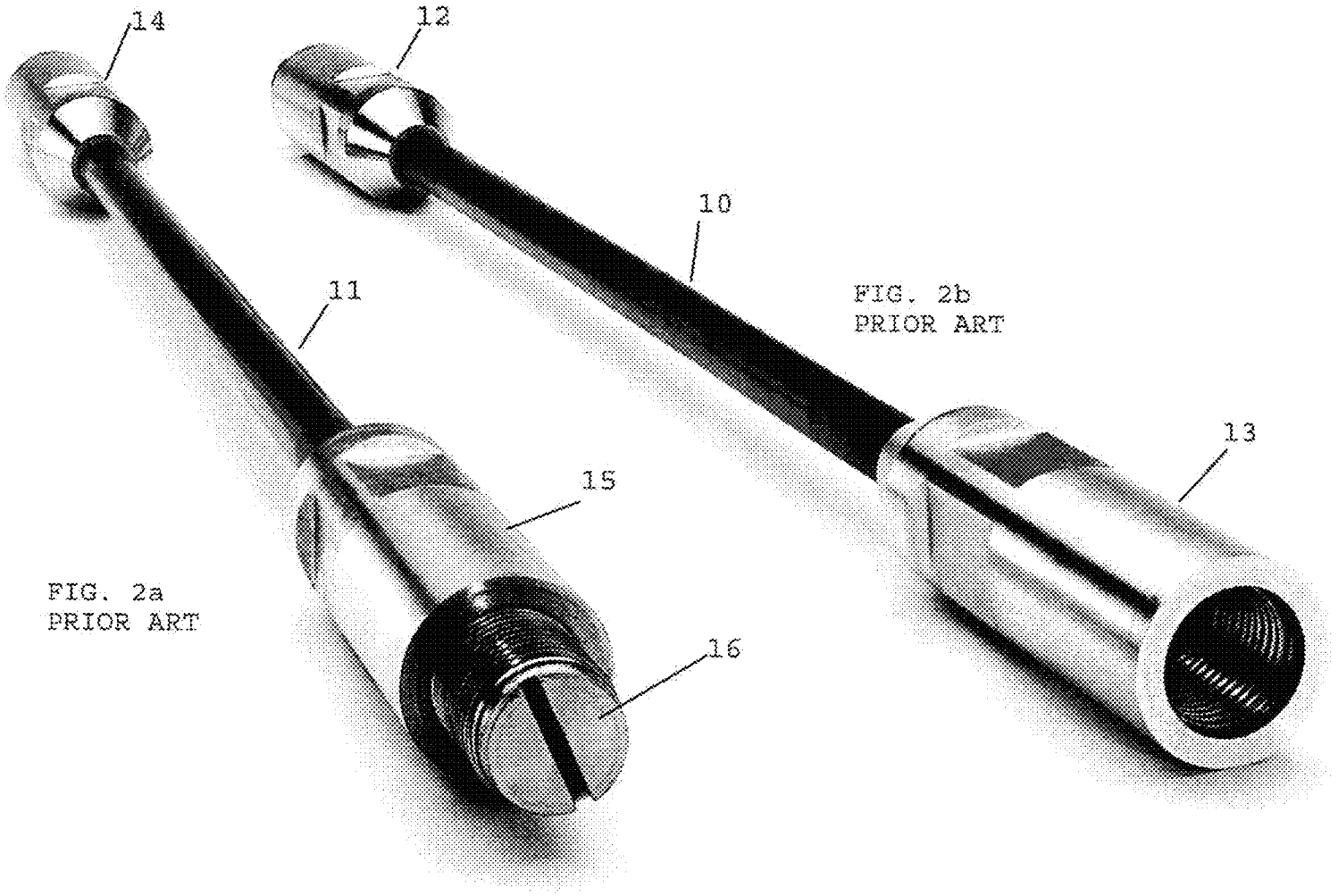
FIG. 2b PRIOR ART
FIG. 2a PRIOR ART
FIGS. 2*a* and 2*b* provide perspective views of two sucker rods used in the prior art.
Figure 3A:
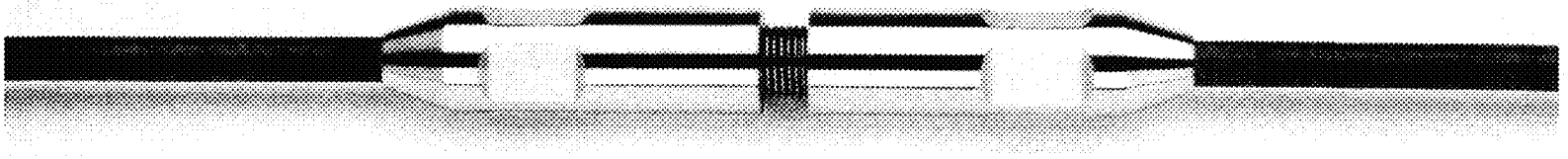
FIG. 3a PRIOR ART
FIGS. 3*a* and 3*b* provide elevational views of sucker rods of the prior art, showing two such sucker rods being joined together.
Figure 3B:
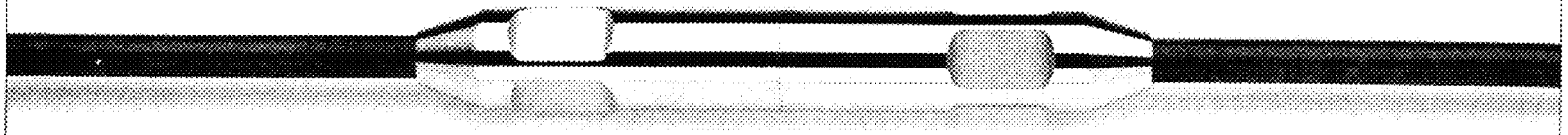
FIG. 3b PRIOR ART

FIGS. 2*a* and 2*b* further illustrate sucker rods of the prior art. Rod 10 is held within fittings 12 and 13, and rod 11 is held within fittings 14 and 15. These two sucker rod segments (or sucker rods) are designed to be connected to one another. The fittings include a threaded portion, such that threaded coupling 16 can engage an adjacent fitting to assemble the string of sucker rods. FIG. 3*a* shows a pair of sucker rods which are being screwed together, and FIG. 3*b* shows the joined sucker rods after one is completely screwed into the other.

Figure 4:
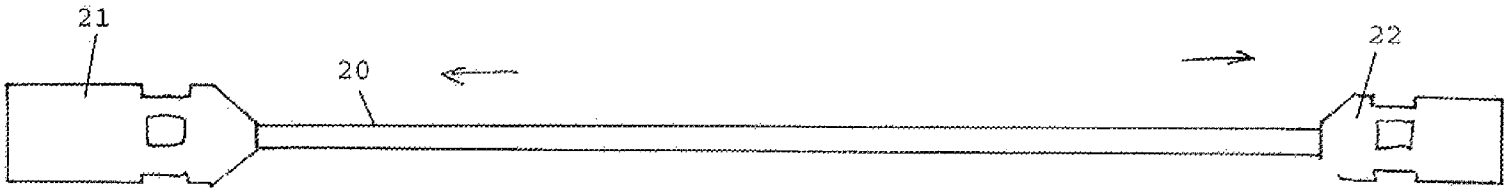
FIG. 4 PRIOR ART
FIG. 4 provides an elevational view of a carbon fiber rod of the prior art, joined to two opposing end fittings.

It has been known to make sucker rods of carbon fiber. Carbon fiber rods are relatively light in weight, and high in tensile strength. A carbon fiber rod 20 is illustrated in FIG. 4, held between fittings 21 and 22. However, such a rod may only be used in tension, and must not be allowed to become compressed. The carbon fiber rod typically has a relatively small diameter, and the rod will buckle, and its fibers will break, if the rod is compressed. On the other hand, the carbon fiber rod stretches when in tension.

Figure 5:
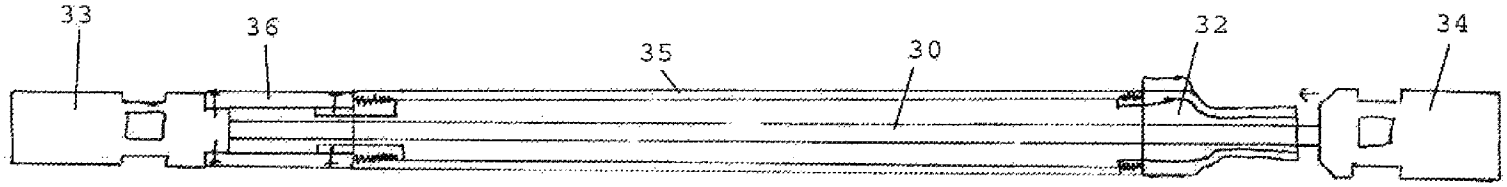
FIG. 5 provides an elevational view of a sucker rod made according to the present Invention.

FIG. 5 provides an elevational view of a sucker rod made according to one embodiment of the present invention. In this embodiment, rod 30 is held between fittings 33 and 34. The rod is surrounded by a cylindrical sleeve 35. On the left-hand side of FIG. 5, there is shown a clamshell spacer 36, and on the right-hand side there is a neckdown connector 32. Both the clamshell spacer 36 and the connector 32 are attached to, and function as a continuation of, the sleeve 35.

When the rod is in tension, i.e. when fitting 34 is moving to the right in the drawing, the rod stretches normally. But when the fitting 34 is moving to the left in the drawing, in a manner that would create a compression load on the rod, the load is transmitted to the sleeve, which bears the compression load. In fact, in the present invention, the components are preferably arranged such that the carbon fiber rod is always in tension, while the compressive forces are transmitted only to the surrounding sleeve.

Thus, an important feature of the present invention is that it provides a sleeve, surrounding the rod, wherein the sleeve absorbs substantially all of the compressive force, thus preventing the rod from being compressed.

Figure 6:
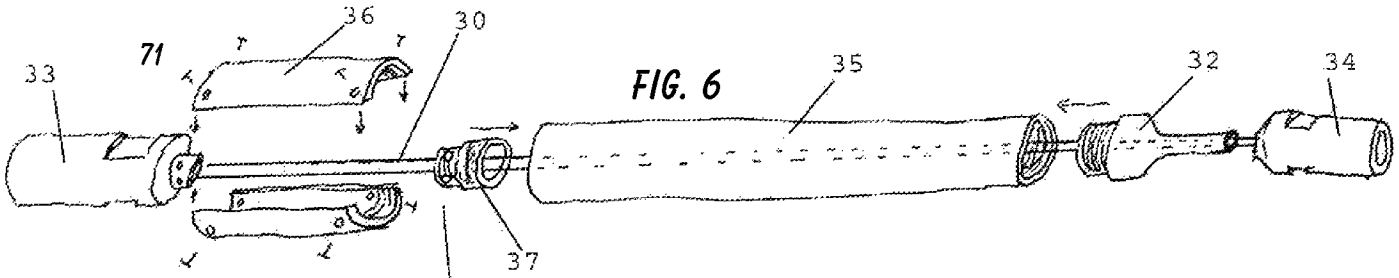
FIG. 6 provides an exploded view of an embodiment of the sucker rod of the present invention.

FIG. 6 provides an exploded view of the sucker rod of the present invention. Similar reference numerals are used to indicate components shown in FIG. 5. Rod 30 is held between fittings 33 and 34, and is surrounded by sleeve 35, which is extended by clamshell spacer 36 and connector 32. In the exploded view, the spacer is shown with its two halves apart. The clamshell spacer is attached to the sleeve by threaded plug 37.

Figure 7:
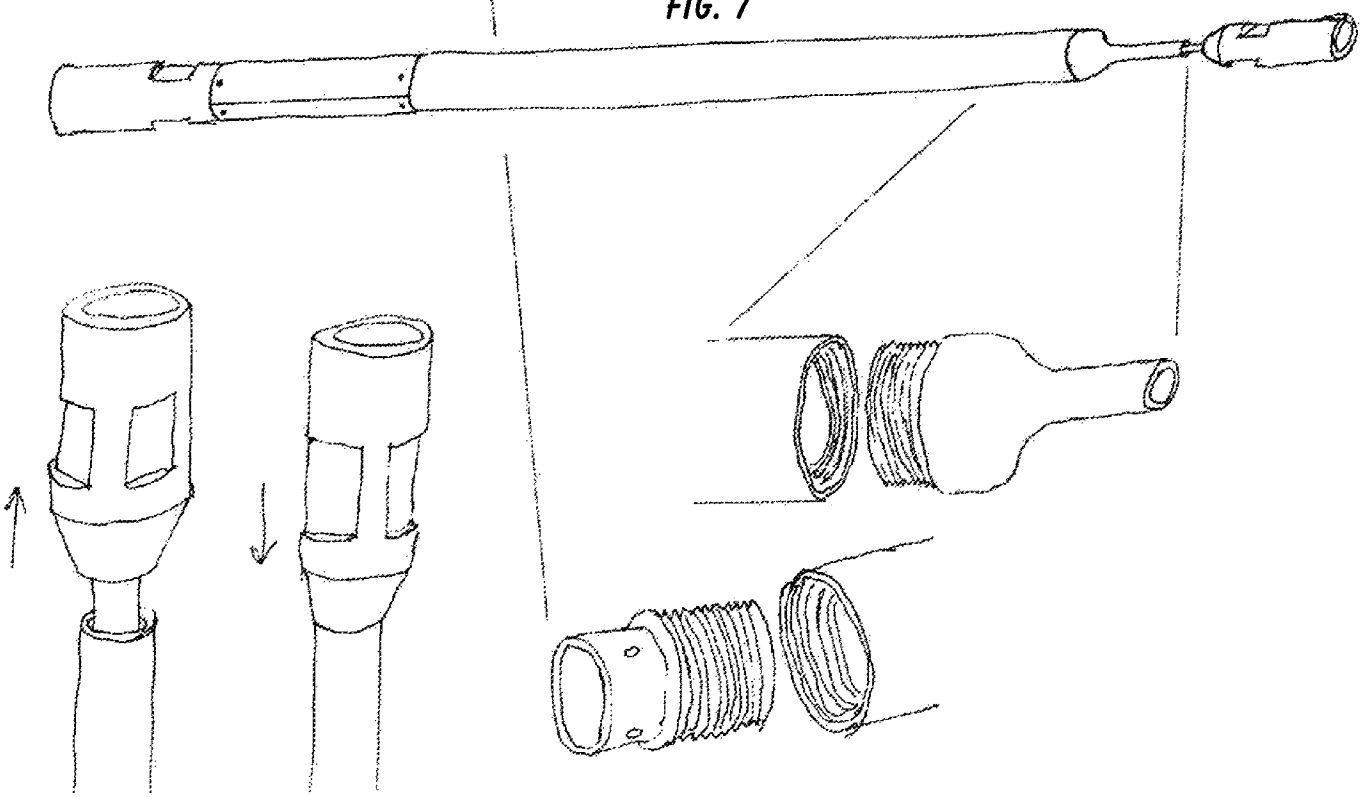
FIG. 7 provides a view of the embodiment of FIG. 6, in the assembled condition.

When the components are assembled, the resulting structure appears as shown in FIG. 7. In principle, the sleeve used in the present invention could be a solid, integral piece extending from one fitting to the other. But in the embodiment shown, the sleeve does not extend along the entire length of the rod, but is instead extended by the clamshell spacer.

The reason is that this construction makes it easier to assemble the components, using the method that will be explained below. In the assembled condition, the clamshell spacer 36 functions entirely as if it were an integral part of the sleeve. That is, the combination of the sleeve and the clamshell spacer, along with the reduced diameter connector, together comprises a structure which bears the compressive forces transmitted when the pumping unit is on its down stroke. The present invention should be deemed to include an embodiment in which the sleeve is an integral structure, extending along most or all of the distance between opposing fittings.

FIGS. 8*a*-8*j* illustrate a method of assembling a sucker rod made according to the present invention. In the present specification, the terms "top" and "bottom" are used to indicate the top and bottom of a rod, when the rod is oriented vertically in the well. The drawings, however, show the rods in a horizontal orientation, for ease of illustration. The terms "top" and "bottom" therefore correspond to "right" and "left", in the drawings, respectively.

Figure 8A:
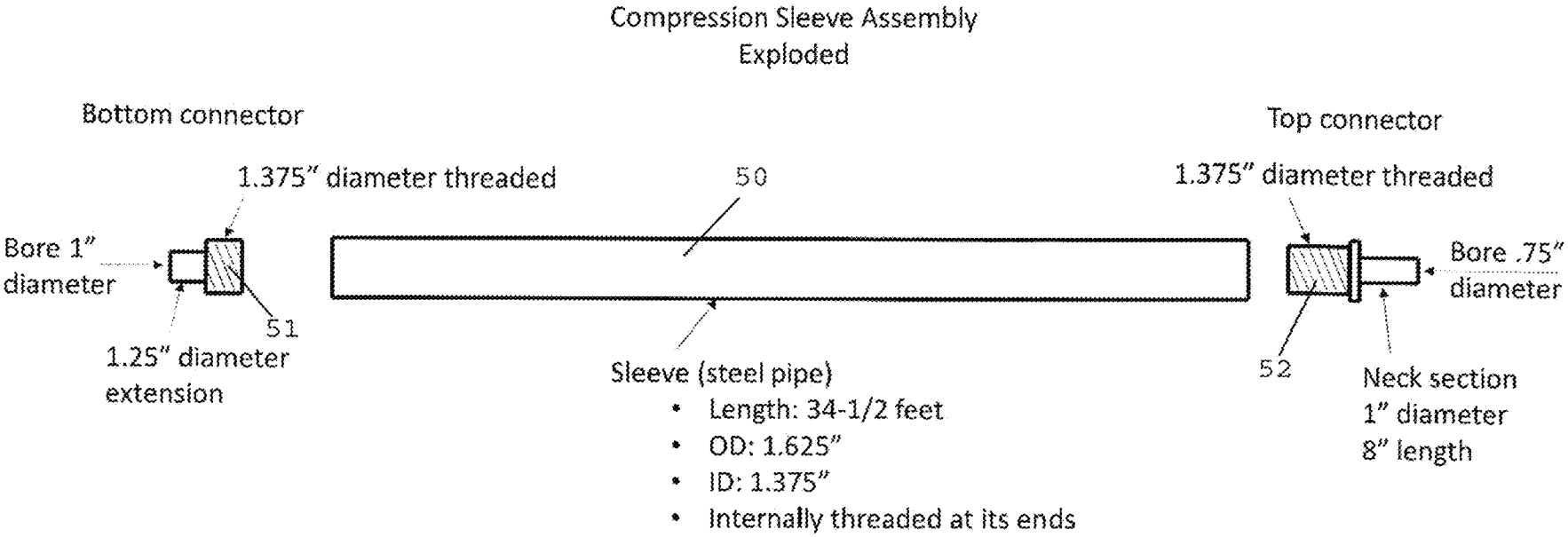
FIG. 8*a* shows an exploded view illustrating a compression sleeve positioned between two connectors.
Figure 8B:
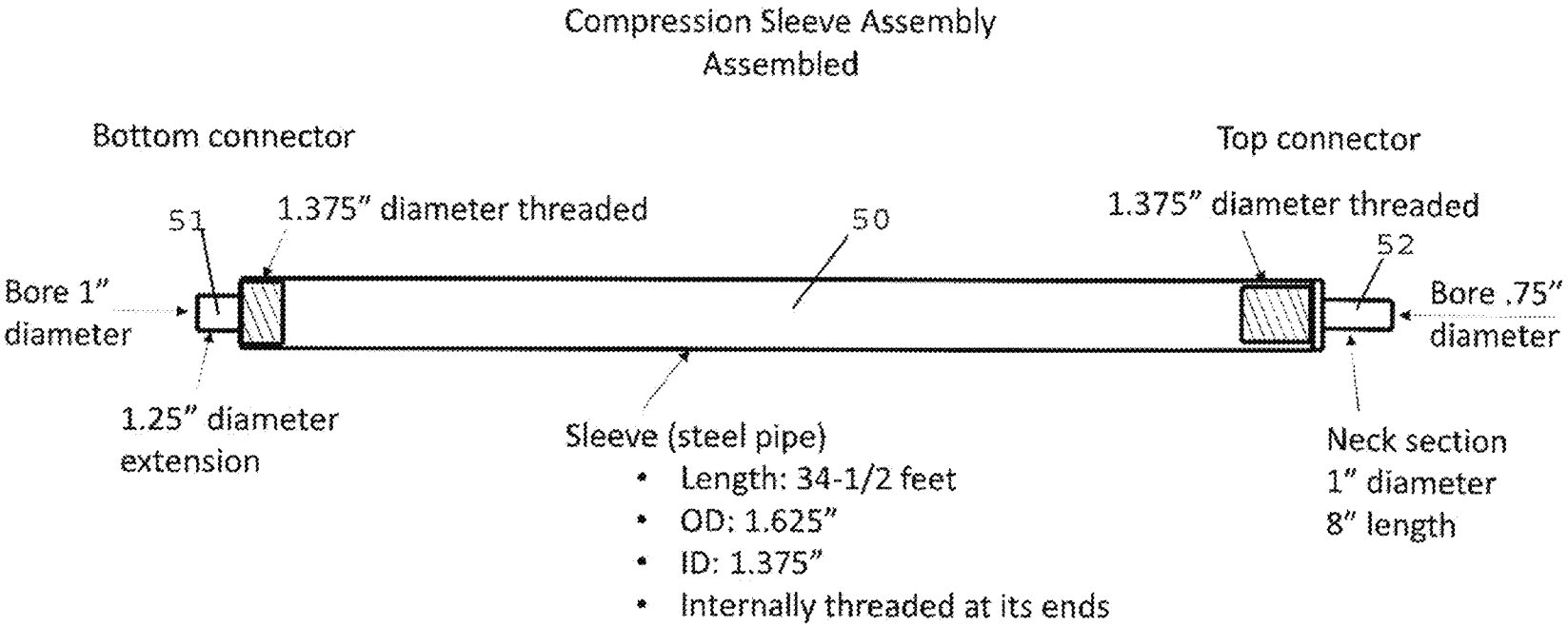
FIG. 8*b* shows the compression sleeve with the connectors screwed into the sleeve.

FIG. 8*a* shows the components of sleeve 50, in an exploded view. The figure includes bottom connector 51 and top connector 52. The sleeve is internally threaded at its ends, and both connectors have a threaded portion, so that the connectors can be screwed into the sleeve. FIG. 8*b* shows the sleeve in its assembled condition, i.e. with the connectors screwed in. The top connector 52 of FIG. 8*a* (also shown in FIGS. 8*b* and 8*d*-8*j*) can also be described as a neck-down connector, as it corresponds to item 32 of FIG. 5. That is, top connector 52 accomplishes a reduction in diameter of the connector, as one moves to the right in the drawing. Like item 32, connector 52 is a one-piece structure, including a larger diameter portion and a smaller diameter portion. The purpose of the neck-down connector is to enable the compression rod assembly to be used with current rod handling equipment in the rig at a well site. If the neck-down section were not used, it would be necessary to provide special tooling to pick up and handle the compression rod assembly, to accommodate the larger diameter outside sleeve.

Figure 8C:
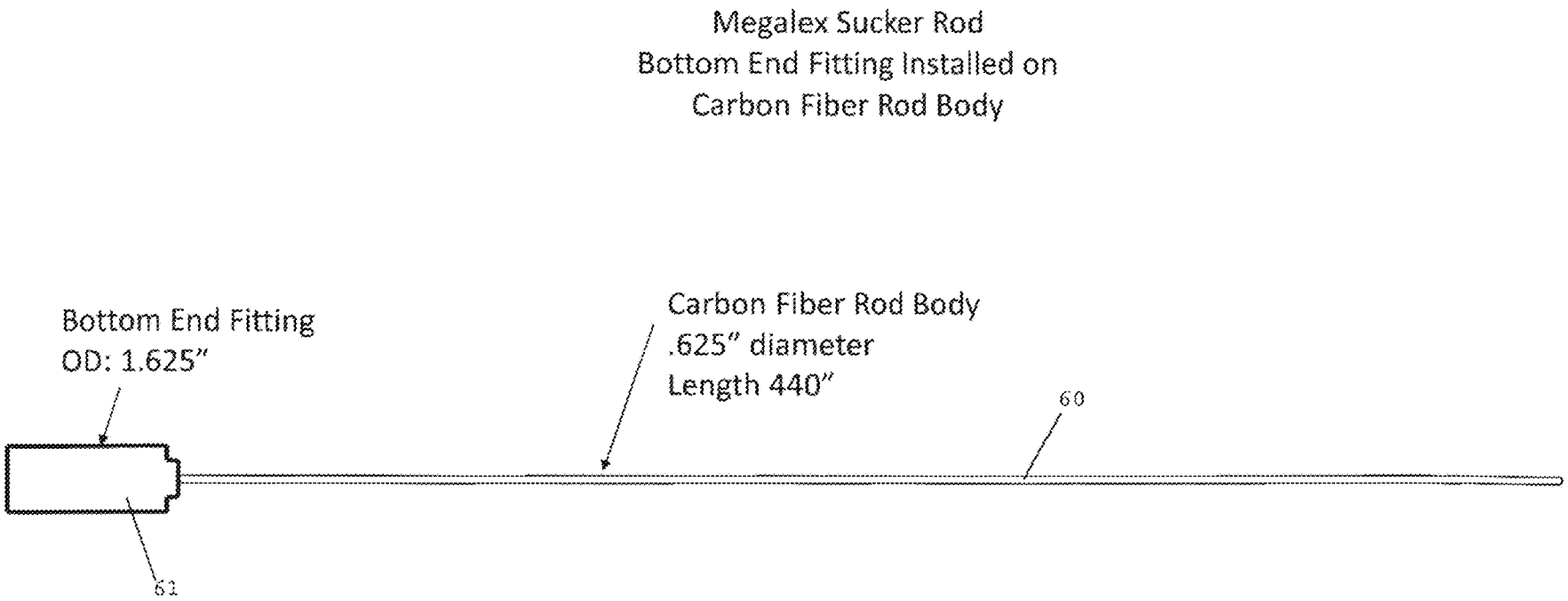
FIG. 8*c* shows a bottom end fitting into which a sucker rod formed of carbon fiber has been inserted.
Figure 8D:
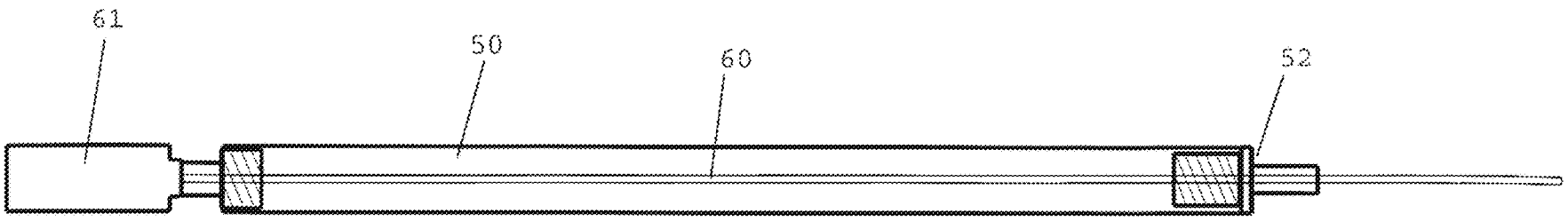
FIG. 8*d* shows the compression sleeve assembly of FIG. 8*b* after it has been slid over the carbon fiber rod of FIG. 8*c;*

FIG. 8*c* shows carbon fiber rod 60, inserted into bottom end fitting 61. After the carbon fiber rod is inserted into bottom fitting 61, one slides the sleeve assembly of FIG. 8*b* over the body of the carbon fiber rod, as shown in FIG. 8*d*.

Figure 8E:
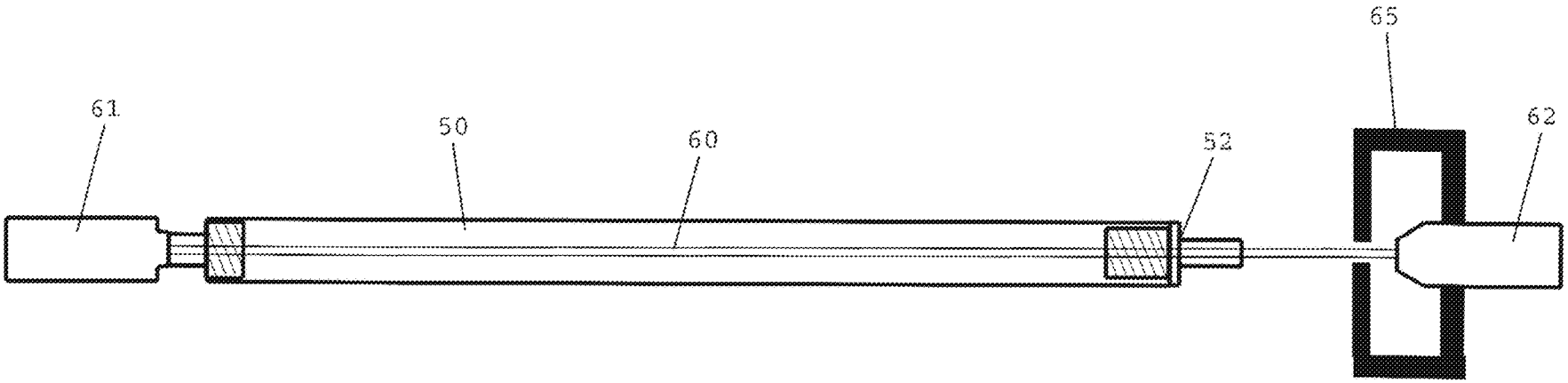
FIG. 8*e* shows a top end fitting which has been moved into position to be secured to the rod body.

In FIG. 8*e*, a top end fitting 62 is attached to the protruding end of the rod 60, the fitting being temporarily held by fixture 65. At this point, for the purpose of reference in later discussion, the length of the rod 60 between the two end fittings 61, 62 is distance D.

Figure 8F:
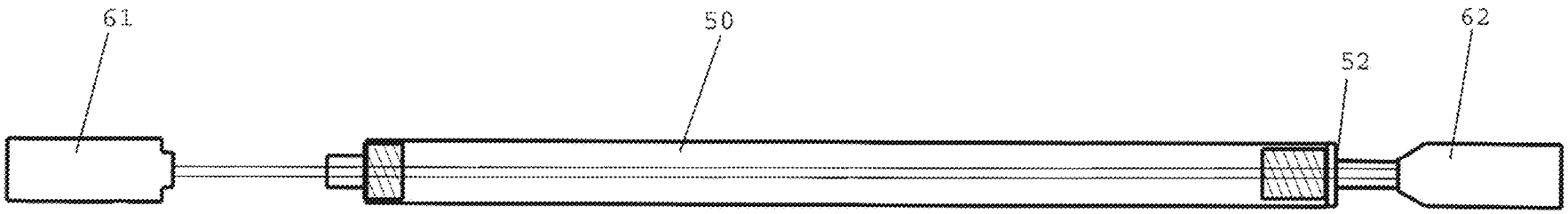
FIG. 8*f* shows the sleeve having been positioned against the top end fitting.
Figure 8G:
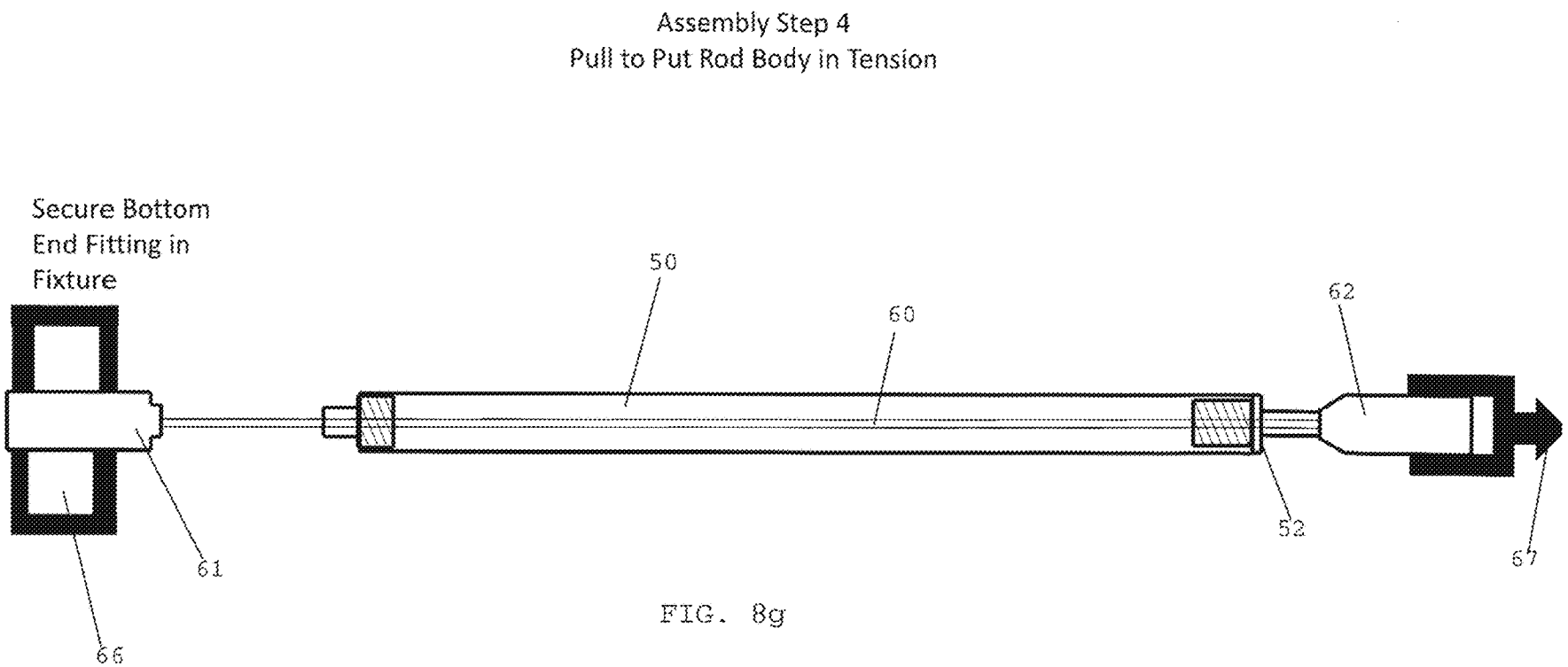
FIG. 8*g* shows the rod being pulled into tension, and showing the securing of the bottom end fitting in a fixture.

Next, as shown in FIG. 8*f*, one slides the sleeve assembly to the right, along the rod, so that the sleeve assembly abuts the top fitting 62, and becomes spaced apart from bottom fitting 61. Then, as shown in FIG. 8*g*, the bottom fitting 61 is held in fixture 66, and the rod is placed into tension, as indicated by arrow 67 near the top fitting. The result of placing the rod 60 into tension is that the rod 60 will be stretched along its length, such that its length will now be D+x. It has been discovered that placing a tension of approximately 10 (ten) pounds will achieve the desired pre-loading of the finally assembled buckle-resistant sucker rod. Consequently, during the stretching step of FIG. 8*g*, some amount of tension beyond this 10 pounds may be applied if the ultimate desired pre-loading is 10 pounds. It should be understood that 10 pounds of force is only exemplary—in other embodiments, other pre-loading values may be desired.

Figure 8H:
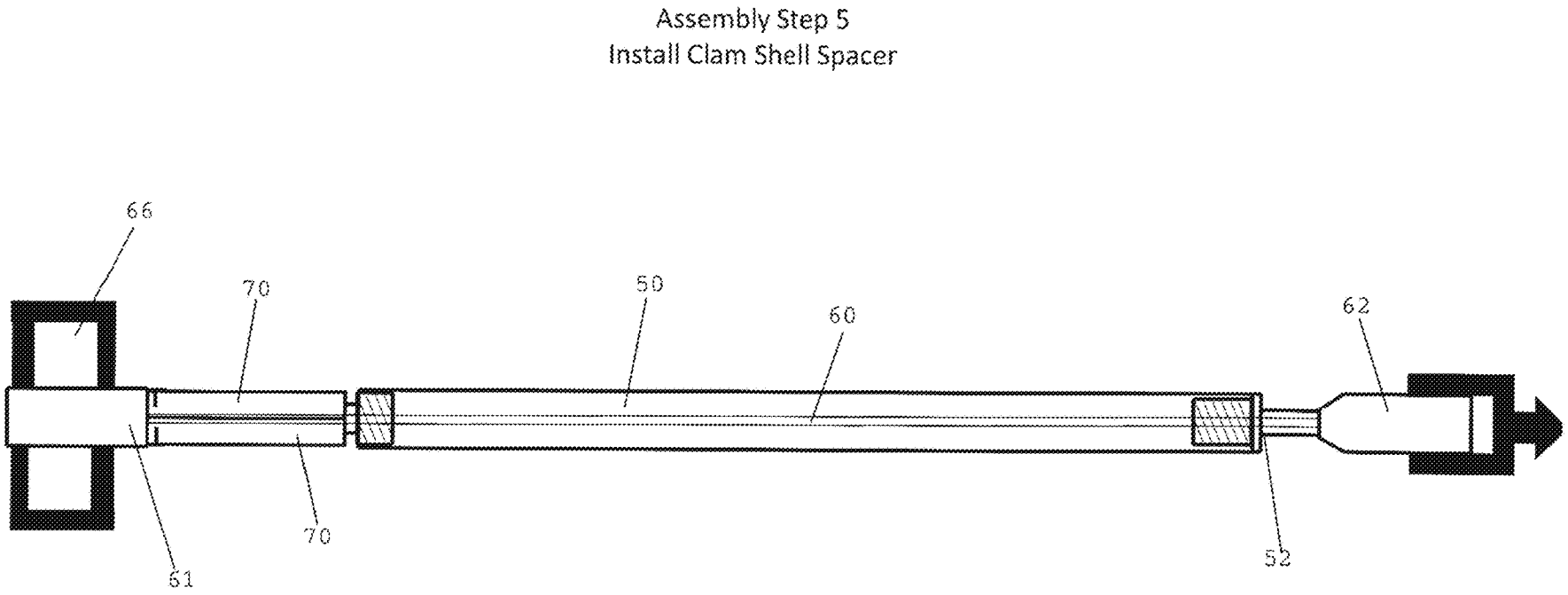
FIG. 8*h* shows the installation of a clamshell spacer, between the sleeve and the bottom fitting.

Next the space between the sleeve assembly and the bottom end fitting is filled by inserting clamshell spacers 70 around the rod, while tension in the rod is maintained, as shown in FIG. 8*h*. The result of inserting the clamshell spacers 70 will increase the overall length of the outer sleeve (i.e. the combination of the sleeve assembly 50 and the clamshell spacers 70) to a length that may be referred to as D+y.

Figure 8I:
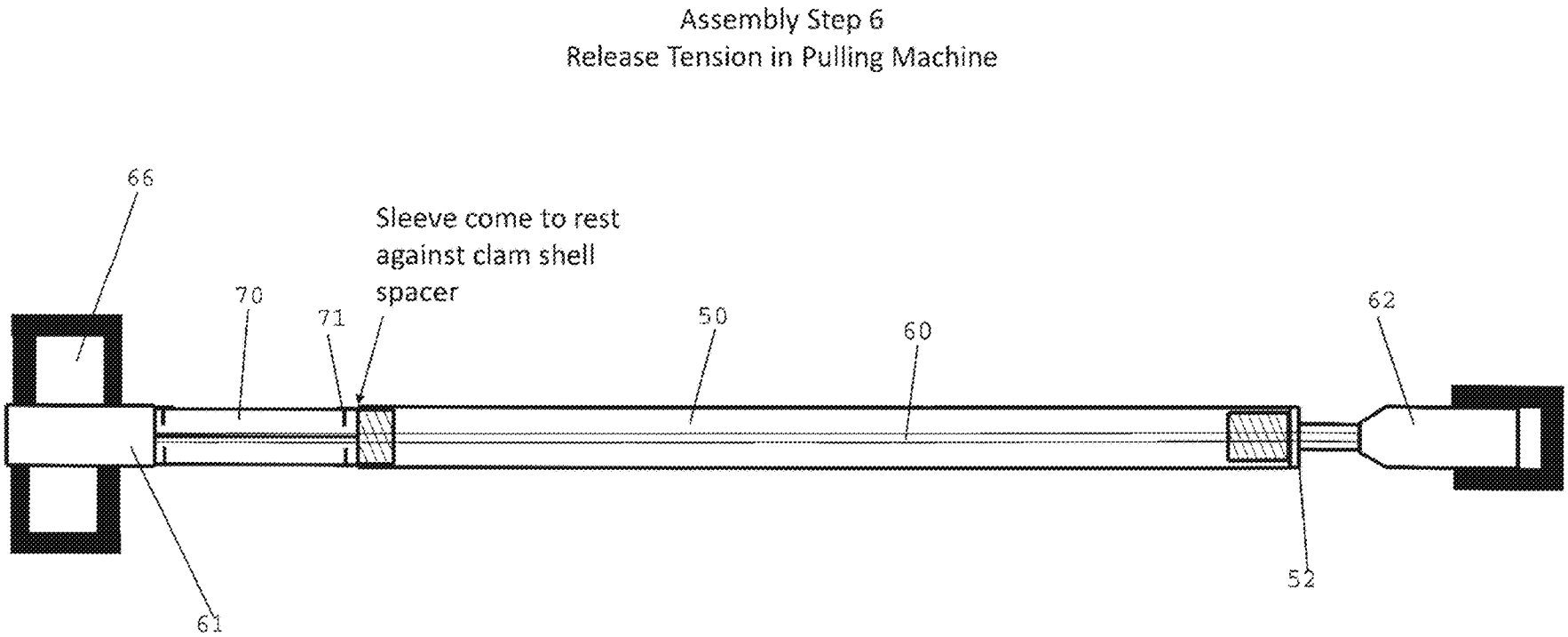
FIG. 8*i* shows the condition wherein the rod tension is released, and the sleeve abuts the clamshell spacer.

Then, the tension in the rod is released, and the sleeve 50 is allowed to come to rest against the clamshell spacers 70, as shown in FIG. 8*i*. The clamshell spacers 70 are affixed to the sleeve 50 by fasteners 71. Again, the new resting length of the rod 60 will be some length that is greater than D, and can be referred to as D+z. It is expected that x>y>z, but the exact dimensions will vary depending upon strength, length and stiffness of the rod 60.

Figure 8J:
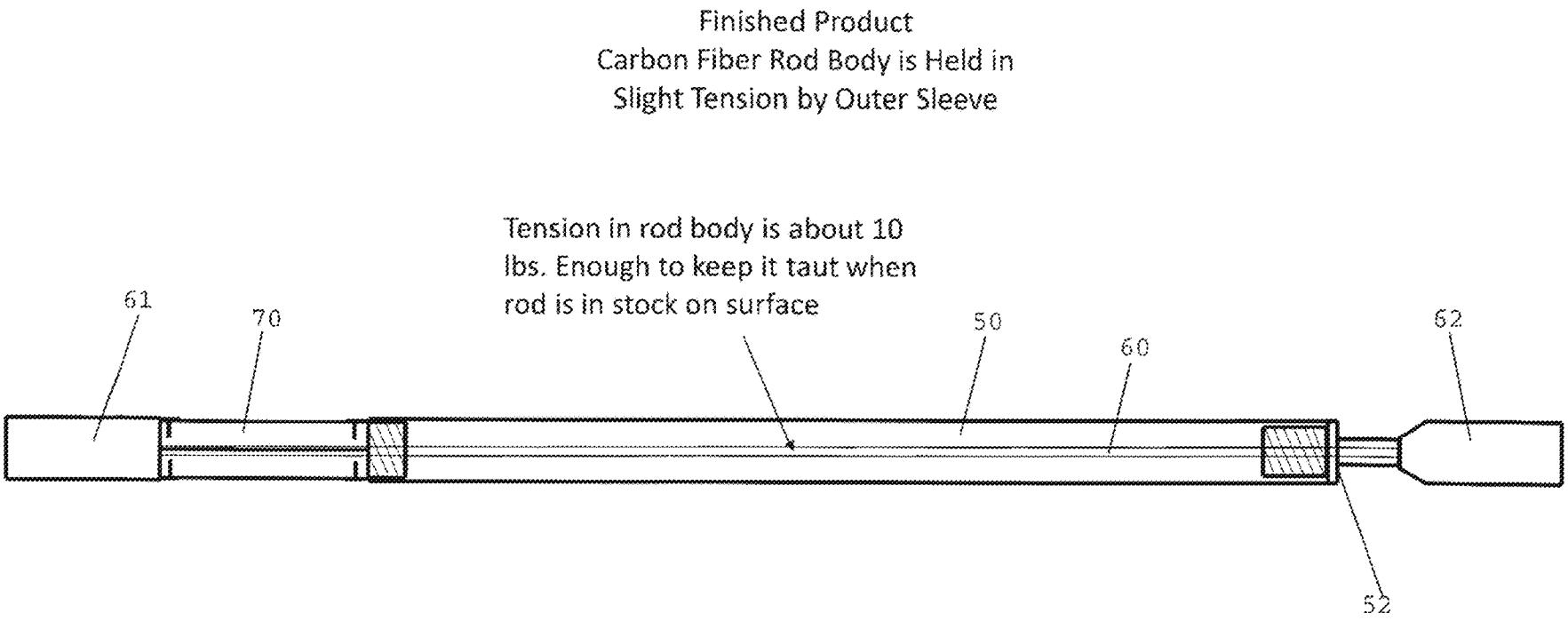
FIG. 8*j* shows the final product, wherein the rod is surrounded by the sleeve, and its clamshell extension, wherein the rod continues to be held in tension, while the sleeve and its extension absorb at least some of the compressive forces.

The finished product is shown in FIG. 8*j*. The carbon fiber or fiberglass rod 60 extends from the bottom end fitting 61 to the top end fitting 62. The sleeve 50, assembled clamshell spacer 70, and top connector (or neck-down connector) 52 surround the carbon fiber or fiberglass rod 60 and effectively comprise a continuation of the rod, so that the clamshell and sleeve and neck-down connector form a structure which extends from one end fitting to the other.

Figure 9:
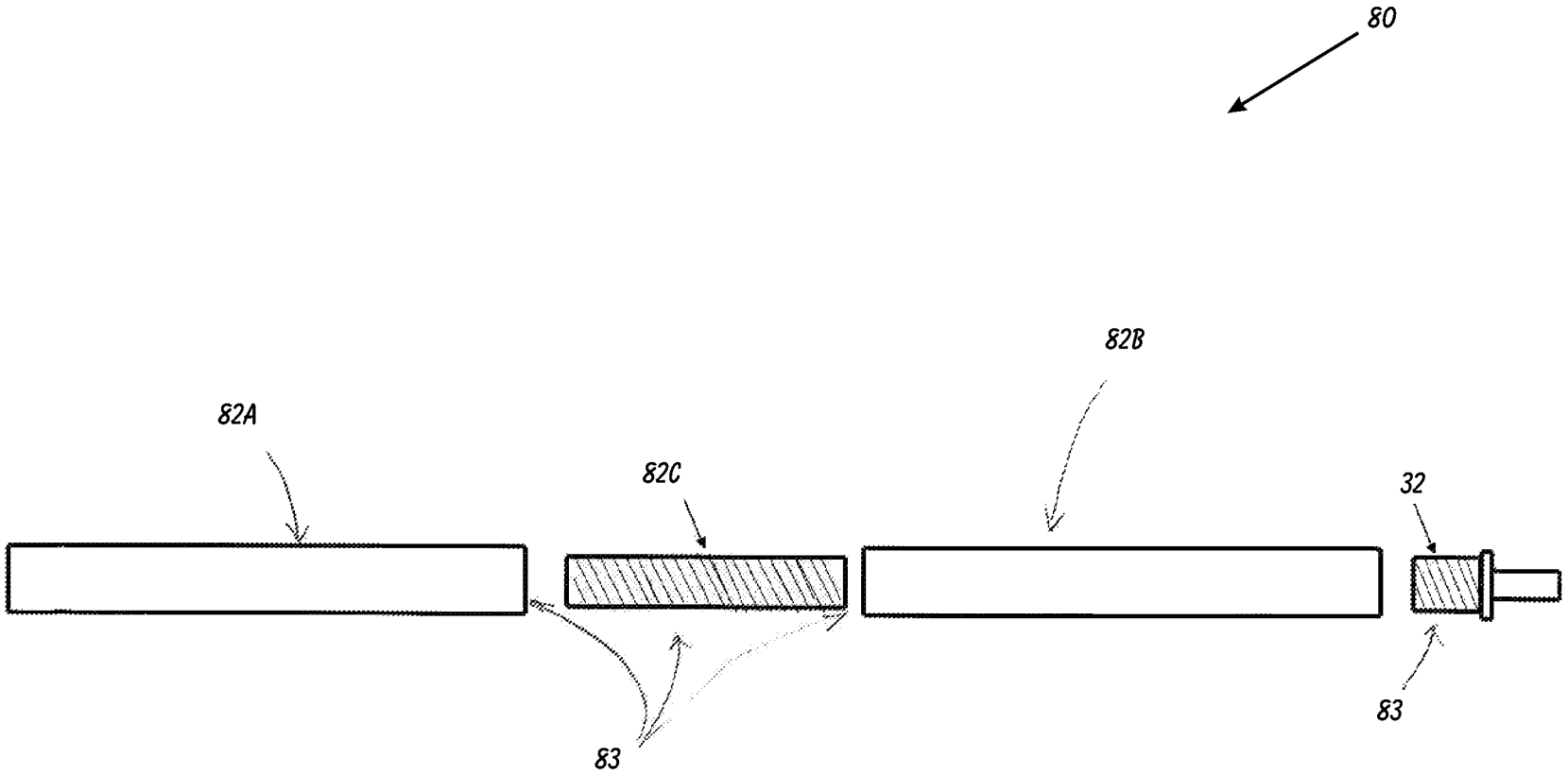
FIG. 9 is an exploded side view of a second embodiment of the sleeve assembly of the present invention.

FIG. 9 is an exploded side view of a second embodiment of the sleeve assembly 80 of the present invention. The installation of this version of assembly 80 involves an alternate series of components. Instead of a single sleeve element [50], there are a pair of elements—first sleeve element 82A and second sleeve element 82B. These are hollow tubes that preferably have threads cut into the internal wall surfaces. The internal threads may extend over the entire length of the elements 82A, 82B, or they could only be in portions (typically adjacent to the ends) of the elements 82A, 82B.

A third sleeve element 82 is also a tubular member having a hollow central bore and threads 83 formed on its outer surface. The purpose of function of these threads 82C are explained below.

Figure 10:
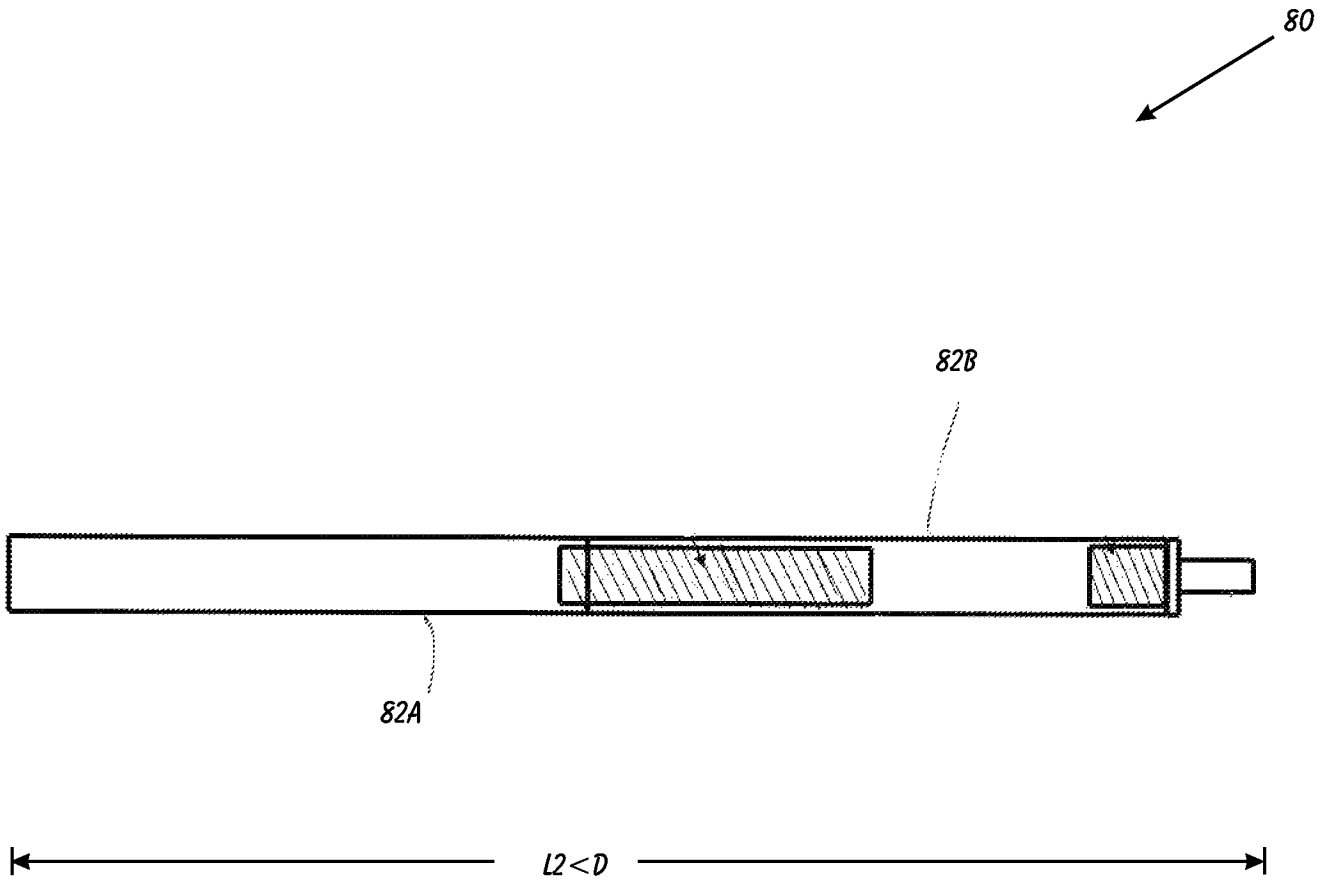
FIG. 10 is a side view of the sleeve assembly of FIG. 9.
Figure 12:
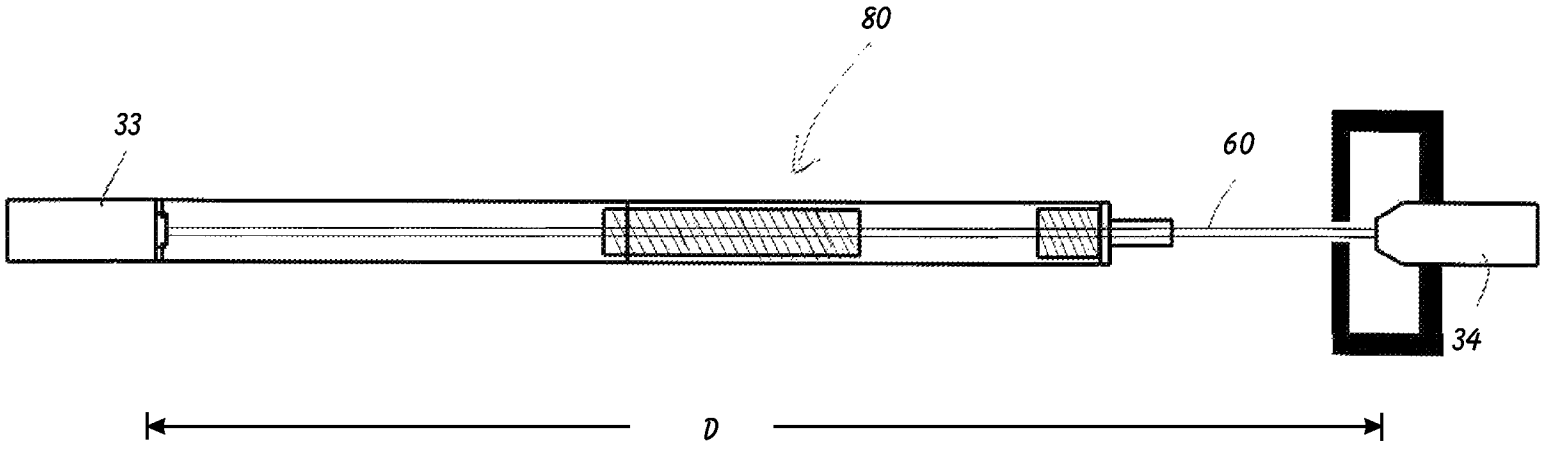
FIG. 12 is a side view of the sleeve assembly of FIGS. 9-11 depicting another stage of installation.

FIG. 10 is a side view of the sleeve assembly 80 of FIG. 9. At this assembly step, the third sleeve element has been threaded into the two sleeve elements 82A, 82B, and the top connector 32 has also been threaded into the second sleeve element 82B. The length of this assembly L(1) is less than length D, with length D being identified in FIG. 12 as being the length of the rod [60] between the two end fittings [33, 34]. As such, the length L(1) of the assembly 80 is less than the length of the rod [60].

Figure 11:
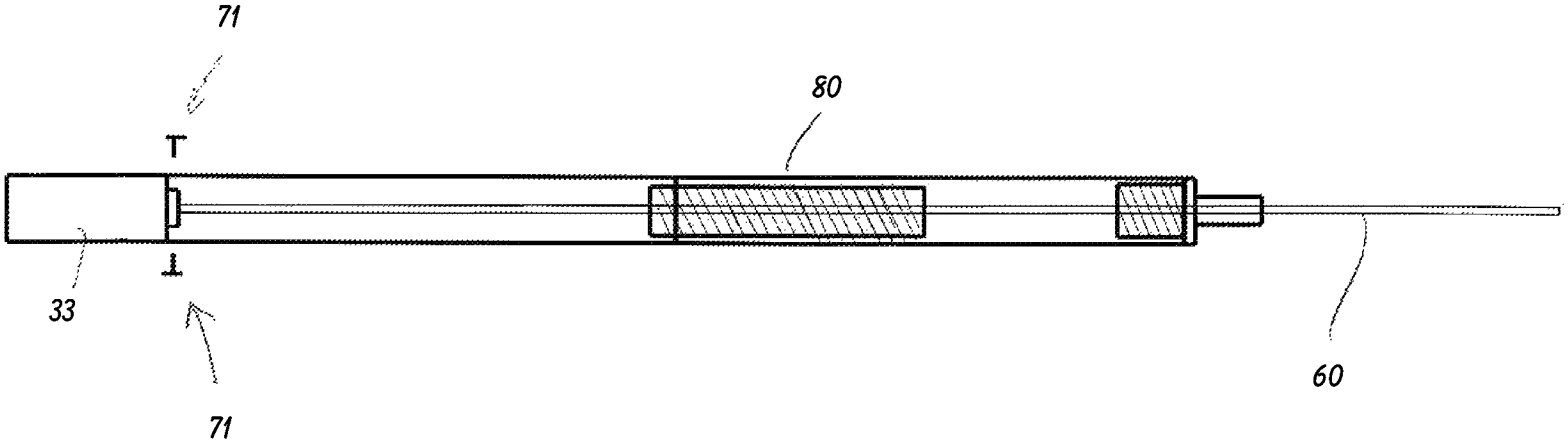
FIG. 11 is a side view of the sleeve assembly of FIGS. 9 and 10 depicting a subsequent stage of its installation.

Next, the bottom end connector 33 is attached to a first end of the rod 60, and the screw-sleeve assembly 80 is slid over the rod 60 and attached to the end connector 33 with a plurality of set screws 71. FIG. 11 depicts the components after the completion of this assembly step.

Figure 13:
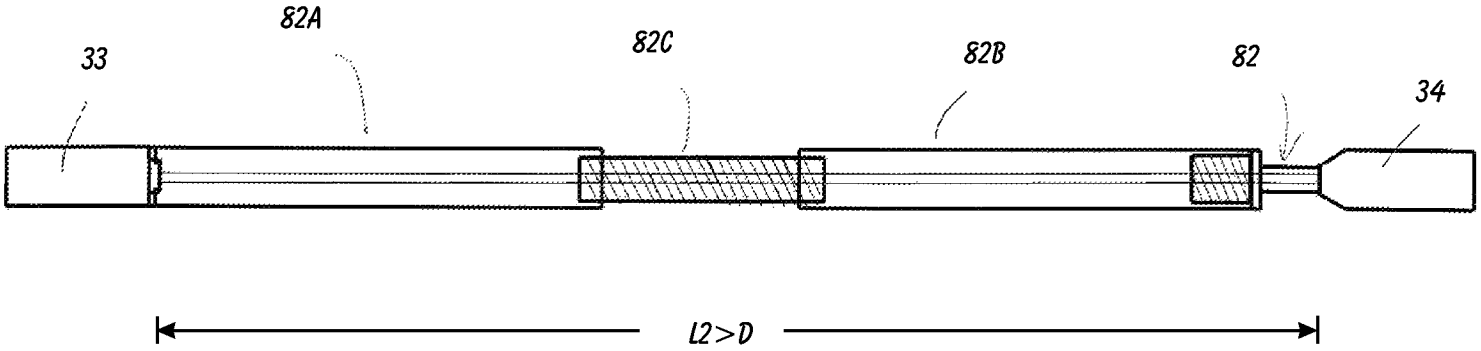
FIG. 13 is a side view of the sleeve assembly of FIGS. 9-12 as its length is increased.

Once sleeve element 82A has been attached to the bottom end fitting 33, the top end fitting 34 is attached to the second end of the rod 60 at a distance D from the bottom end fitting 34, and fixed thereto. The rod 60 is then placed under tension such that its length L2 is now greater than D. At this point, the first sleeve element 82A and second sleeve element 82B are rotated in opposite directions relative to one another such that the third sleeve element 82C begins to "unscrew" from one or both sleeve elements 82A, 82B such that the sleeve elements 82A, 82B spread apart. The sleeve elements 82A, 82B are expanded until the top connector 32 reaches (or nearly reaches) the top fitting 34. At this point, the tension on the rod 60 is released, and the assembly is left in the condition shown in FIG. 13, wherein the rod 60 remains in a tension condition.

It should also be understood that the tension on the rod 60 could actually be created by the expansion/extension of the screw-sleeve element 80 such that it pushes outwardly on the bottom and top fittings 33, 34 until the desired tension is reached.

Figure 14:
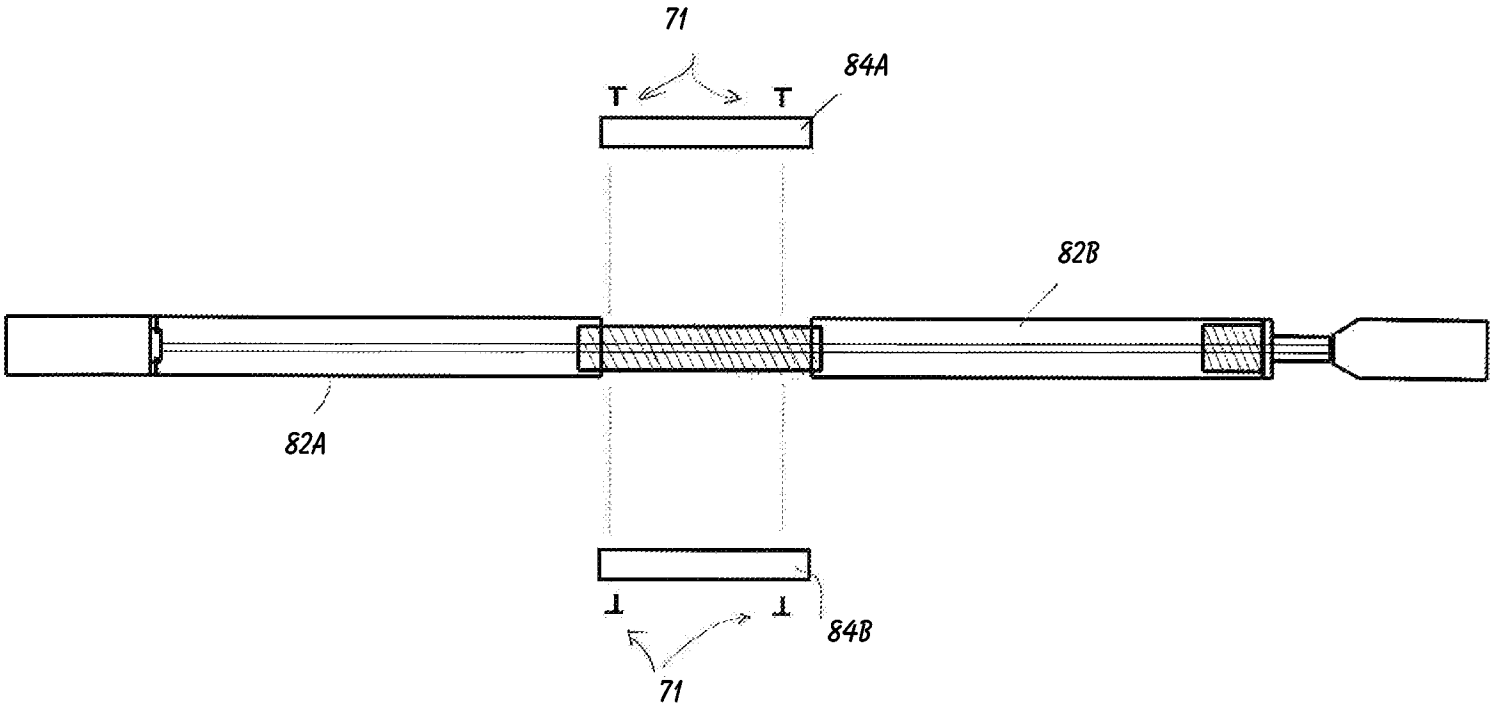
FIG. 14 is a side view of the sleeve assembly of FIGS. 9-13 wherein clamshell spacers are being installed.

In a final step depicted in FIG. 14, clamshell inserts 84A and 84B could be attached over the third sleeve element 82C in order to prevent the length from changing, and to protect the threads of the third sleeve element 82C from damage. Set screws 71 may be attached to fix the inserts 84A, 84B to sleeve elements 82A, 82B.

Figure 15:
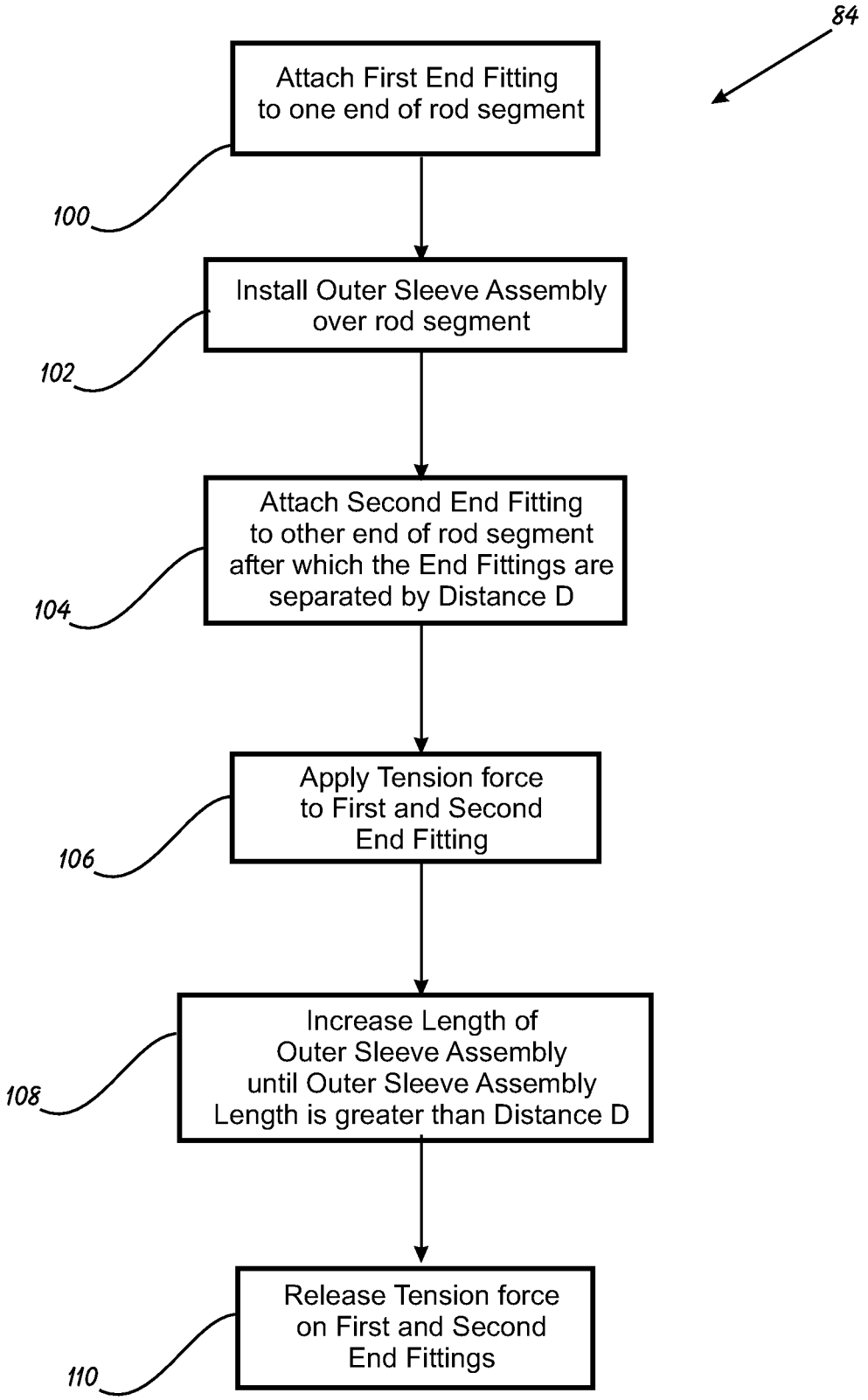
FIG. 15 is a flowchart depicting the steps of assembling the buckling-resistant sucker rod of the present invention according to the steps depicted in FIGS. 8*a*-8*j*.
Figure 16:
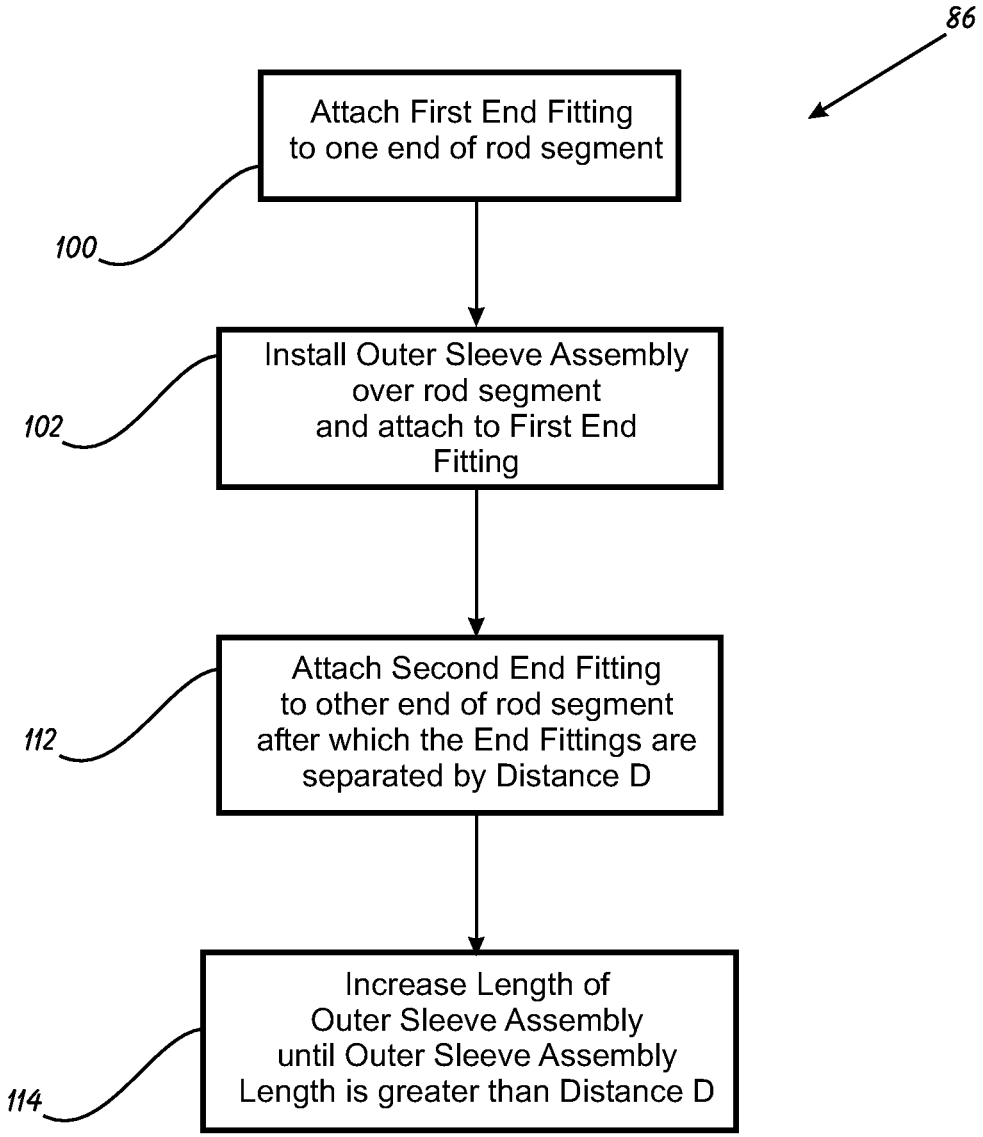
FIG. 16 is a flowchart depicting the steps of assembling the buckling-resistant sucker rod of the present invention according to the steps depicted in FIGS. 9-14.

The two methods depicted above are described below in connection with FIGS. 15 and 16. FIG. 15 is a flowchart depicting the steps of assembling the buckling-resistant sucker rod of the present invention according to the steps depicted in FIGS. 8*a*-8*j*, and FIG. 16 is a flowchart depicting the steps of assembling the buckling-resistant sucker rod of the present invention according to the steps depicted in FIGS. 9-14.

In the first method of assembly 84, the first end fitting is attached to one end of the rod 100, after which the outer sleeve assembly is fitted over the rod 102. The second end fitting is then attached to the opposing rod end 104 such that the two end fittings are at a distance of D from one another.

A pre-determined tension force is applied to the end fittings 104, which will also cause the rod to stretch (i.e. the length will increase). Next, the length of the previously-installed outer sleeve assembly will be increased until it is greater than D 108. The lengthening of the outer sleeve assembly could be via the clamshell inserts discussed above, or by another method of increasing (e.g. telescopically) the sleeve assembly length. At this point the tension force will be released from the two end fittings 110.

In the second method 86, the first end fitting is attached to one end of the rod 100. The outer sleeve assembly is then installed over the rod and attached to the first end fitting 102. The second end fitting is then attached to the other end of the rod such that the end fittings are separated by distance D 112. Finally, the length of the outer sleeve is lengthened (either before or after placing the rod under tension by pulling on the two end fittings) until the length of the outer sleeve assembly (and therefore the distance between the two end fittings) is now greater than D 114.

The present invention is not intended to be limited by the specific method of assembly described above. Moreover, the invention is not limited to an embodiment in which the sleeve is extended by clamshell spacers, or other spacers. The invention is intended to include embodiments wherein an integral sleeve is positioned between fittings, so as to accommodate compressive loads.

Although the invention has been described with respect to relatively light-weight carbon fiber rods, the invention is not limited according to the material of any component. The rods could be made of steel, or fiberglass, or some other material, instead of carbon fiber. Similarly, the sleeve is not limited to steel, but could be made of any other material which is sufficiently strong to withstand the compressive loads produced during the down stroke of a pumping unit. Regardless of the materials used, the principle of the invention is the same, i.e. that the rod can be maintained always in tension, while compressive loads are borne by the surrounding sleeve.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A pump rod assembly, comprising:
- an inner rod element defining opposing ends;
- a first end fitting attached to one said inner rod end;
- a second end fitting attached to the other said end of said inner rod; and
- an outer rod sleeve extending between said first and second end fittings, configured to cooperate with said rod and end fittings such that said inner rod element is under a predetermined tension load, said outer rod sleeve comprising:
  - a first sleeve element;
  - a second sleeve element; and
  - a third sleeve element interconnecting said first sleeve element and said second sleeve and threadedly engaging said first sleeve element and said second sleeve element, with said threaded engagement generating said tension load on said inner rod element by said outer rod sleeve pressing against said end fittings.

2. The assembly of claim 1, wherein said inner rod element is formed from non-metallic material.

3. The assembly of claim 2, wherein said outer rod sleeve is formed from a metallic material.

4. The assembly of claim 1, wherein said outer rod sleeve comprises:
- a first sleeve assembly comprising said first sleeve element defining a hollow tube comprising an inner wall defined by threads formed thereon;
- said second sleeve element comprising a hollow tube having an inner wall defined by threads formed thereon; and
- said third sleeve element comprises a hollow tube having an outer wall defined by threads formed thereon to cooperate to threadedly engage said first and second sleeve elements.

5. The assembly of claim 1, further comprising a second sleeve assembly encasing said third sleeve element, said second sleeve assembly comprising a pair of half-sleeve elements attached to one another along and adjacent to a pair of longitudinal edges.

6. A method for forming a pump rod assembly, comprising the steps of:
- attaching a first end fitting to an elongate inner rod;
- attaching an outer rod sleeve assembly over said inner rod between adjacent to said first end fitting, said outer rod sleeve assembly comprising:
  - at least one internally-threaded sleeve element defined by a hollow tubular member having an inner wall with threads formed on said inner wall; and
  - at least one externally-threaded sleeve element defined by a hollow tubular member having an outer wall with threads formed on said outer wall,
  - whereby said inner wall threads threadedly engage said outer wall threads;
- attaching a second end fitting to an opposing end of said elongate inner rod whereby said end fittings are separated by a distance of L;

pulling said end fittings in order to stretch said inner rod until said end fittings are separated by a distance of (L+x);

adjusting said threaded engagement between said sleeve elements until the length of said outer rod sleeve assembly has a length of between L and (L+x); and ceasing said pulling of said end fittings.

7. The method of claim 6, wherein said outer rod sleeve assembly of said attaching step comprises a first said internally threaded elongate tubular member terminating in a first end and an opposing second end threadedly engaging said externally-threaded sleeve element and a second internally-threaded elongate tubular member threadedly engaging said externally-threaded sleeve element at an opposite end.

8. The method of claim 7, further comprising attaching at least two elements attached to one another along their respective longitudinal edges to encase said externally-threaded sleeve element.

9. The method of claim 8, wherein said two elements of said two element attaching step each form a "C" shaped cross-section.

10. The method of claim 6, wherein said outer rod sleeve assembly of said attaching step comprises one said externally-threaded elongate tubular member adjacent to one said internally-threaded tubular member at a first end and to one said internally-threaded tubular member at a second end, said three elongate tubular members threadedly engage to form said outer rod sleeve assembly.

11. A method for forming a buckling-resistant well pump rod assembly, comprising the steps of:

attaching a first end fitting to an elongate inner rod, said inner rod being formed of non-metallic material;

attaching an outer rod sleeve assembly over said inner rod adjacent to said first end, said outer rod assembly comprising at least two interconnected outer sleeve elements defining an overall length that is less than L;

attaching a second end fitting to an opposing end of said elongate inner rod whereby said end fittings are separated by a distance of L; and extending the length of said outer rod sleeve assembly until said outer rod sleeve assembly defines an overall length of L+x, whereby said inner rod is under tension and said outer rod sleeve assembly is under compression.

12. The method of claim 11, wherein said outer rod sleeve assembly of said attaching step comprises a first elongate tubular member terminating in a first end and an opposing second end and a second elongate tubular member adjacent thereto, said first elongate tubular member and said second elongate tubular member being in threaded engagement.

13. The method of claim 12, wherein said attaching step further comprises attaching at least two elements attached to one another along their respective longitudinal edges to encase one of said elongate tubular members.

14. The method of claim 13, wherein said two elements of said attaching step each form a "C" shaped cross-section.

15. The method of claim 12, wherein said first and second elongate tubular members of said attaching step threadedly engage one another by threads formed on their respective inner and outer surfaces.

16. The method of claim 15, wherein said outer rod sleeve of said attaching step comprises a third elongate tubular member adjacent to either said first or said second elongate tubular member, and said three elongate tubular members threadedly engage to an adjacent said elongate tubular member to form said outer rod sleeve assembly.

17. The method of claim 16, wherein said first, second and third tubular members of said attaching step are defined by:

said first and second tubular members both have threads formed on their respective internal walls; and said third tubular member has threads formed on its outer wall, whereby it is configured to threadedly engage said first and second tubular members.

* * * * *